US008033427B2

(12) United States Patent
Drennow

(10) Patent No.: US 8,033,427 B2
(45) Date of Patent: Oct. 11, 2011

(54) COUPLING ARRANGEMENT, COUPLING DEVICES AND USE OF COUPLING DEVICE

(75) Inventor: Sten Drennow, Lund (SE)

(73) Assignee: Asept International AB, Lund (SE)

( * ) Notice: Subject to any disclaimer, the term of this patent is extended or adjusted under 35 U.S.C. 154(b) by 856 days.

(21) Appl. No.: 11/901,037

(22) Filed: Sep. 14, 2007

(65) Prior Publication Data

US 2009/0071976 A1 Mar. 19, 2009

(51) Int. Cl.
*B67D 1/00* (2006.01)

(52) U.S. Cl. ..... 222/83; 222/81; 222/105; 222/153.06; 222/569

(58) Field of Classification Search ..... 222/80, 222/81, 83, 83.5, 87, 105, 107, 153.06, 569, 222/183
See application file for complete search history.

(56) References Cited

U.S. PATENT DOCUMENTS

| | | | | |
|---|---|---|---|---|
| 2,955,722 | A | 10/1960 | Antonious | |
| D229,735 | S | 1/1974 | Croyle et al. | |
| 4,576,313 | A * | 3/1986 | Smith et al. | 222/81 |
| D296,862 | S | 7/1988 | Beltz | |
| 4,768,674 | A | 9/1988 | Prescott | |
| 5,133,293 | A | 7/1992 | Boozer | |
| 5,135,195 | A | 8/1992 | Dane | |
| 5,407,099 | A * | 4/1995 | Heuke et al. | 222/83 |
| D362,995 | S | 10/1995 | Marsico | |
| 5,655,742 | A | 8/1997 | Whitman et al. | |
| 5,839,711 | A | 11/1998 | Bieck et al. | |
| D429,111 | S | 8/2000 | Busick et al. | |
| D448,974 | S | 10/2001 | Hydak et al. | |
| D486,158 | S | 2/2004 | Lei et al. | |
| 2004/0195273 | A1 | 10/2004 | Antal Sr. | |
| 2008/0272084 | A1 | 11/2008 | Lohrman et al. | |
| 2009/0001103 | A1 | 1/2009 | Wanbaugh | |

FOREIGN PATENT DOCUMENTS

| | | | |
|---|---|---|---|
| EP | 1 700 818 | A1 | 9/2006 |
| WO | WO 02/26586 | A1 | 4/2002 |

* cited by examiner

*Primary Examiner* — Kevin P Shaver
*Assistant Examiner* — Melvin Cartagena
(74) *Attorney, Agent, or Firm* — Tarolli, Sundheim, Covell & Tummino LLP

(57) ABSTRACT

The present invention concerns a coupling arrangement for coupling a withdrawal arrangement (4) to a package (1) with liquid or essentially liquid contents (3), which withdrawal arrangement (4) is intended for the removal of the contents (3) from the package (1). The coupling arrangement (5) comprises not only an inner coupling device (9) that is arranged within the package (1) but also an outer coupling device (12) that is arranged on the withdrawal arrangement (4). The outer coupling device (12) comprises a tube section (14) with which the unbroken part (11) of the wall of the package (1) can be broken and that can be introduced into the hole (15) in the outer part (10) of the inner coupling device (9) in order to be coupled to this such that the contents (3) in the package (1) can be withdrawn through the tube section (14). At least one protruding part (16) is arranged on the outer coupling device (12). At least one space (17) is arranged in the outer part (10) of the inner coupling device (9). The protruding part (16) can be introduced into the said space (17) without breaking the unbroken part (11) of the wall (2).

15 Claims, 2 Drawing Sheets

6
4
8
7
13

14a
16
14b
5
12
16
14
A
B
10b
15
11
17
10c
1
10a
10
2
3
17a
17b
9
20
19

Fig. 2
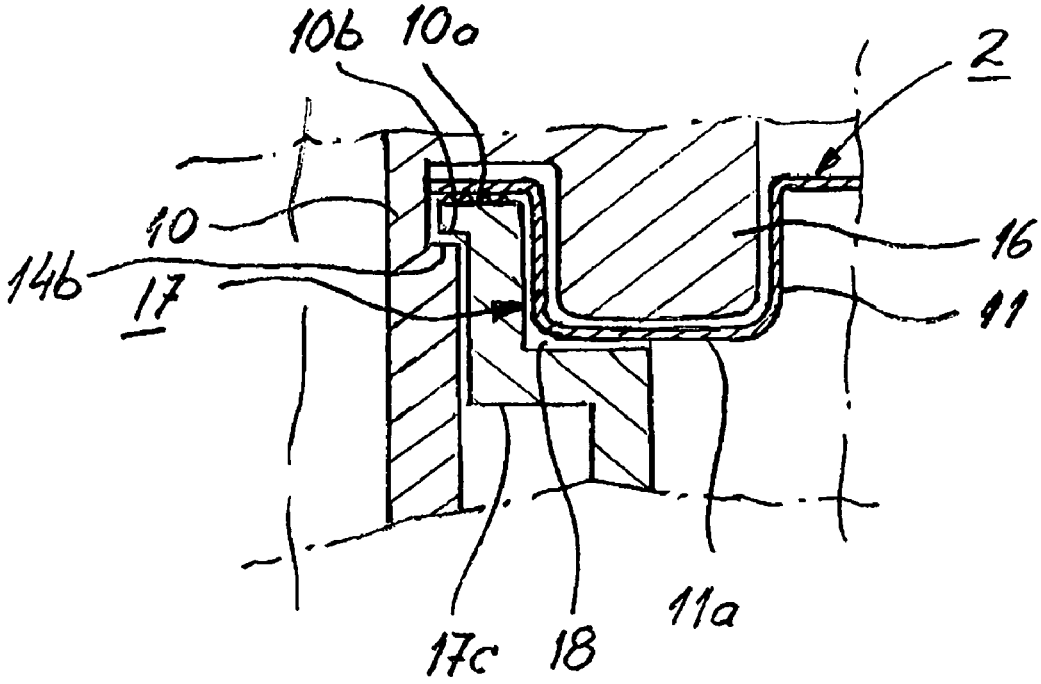
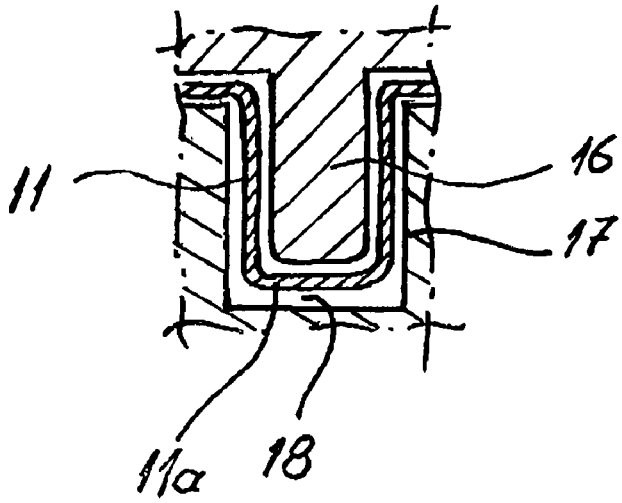
Fig. 3

COUPLING ARRANGEMENT, COUPLING DEVICES AND USE OF COUPLING DEVICE

FIELD OF THE INVENTION

The present invention relates to a coupling arrangement for coupling of a withdrawal arrangement to a package with liquid contents, through which withdrawal arrangement the contents are to be withdrawn from the package. The package consists, at least to a significant degree, of synthetic materials. The coupling arrangement comprises an inner coupling device with a part that is provided with holes and that is arranged on the inner surface of an unbroken part of the wall of the package. The coupling arrangement also comprises an outer coupling device that is arranged on the withdrawal arrangement. The outer coupling device comprises a tube section with which the unbroken part of the package can be broken and that can be introduced into the hole in the part that is provided with holes in order to be coupled to this part such that the contents of the package can be withdrawn through the tube part. The invention relates also to coupling devices and the use of a coupling device.

BACKGROUND OF THE INVENTION

Coupling arrangements of the type described in the introduction are known from the document EP 1700818. This document describes a coupling arrangement with inner and outer coupling devices. The outer coupling device is provided with a protruding part and the inner coupling device with holes for the protruding part. The protruding part can be introduced in the holes but the unbroken wall of the package must be penetrated by the protruding part for carrying out this operation.

It has proved to be the case that there is a need for coupling devices that have protruding parts to be introduced in holes but without penetrating wall portions of the package.

SUMMARY OF THE INVENTION

The aim of the present invention has been to remove this deficiency, and this has been achieved through the coupling arrangement named in the introduction principally comprising the characteristics that are made clear by the attached claims 1, 14 and 15.

The coupling devices can be coupled without penetrating the wall of the package with the protruding part because this part is introducing an unbroken part of the wall into the space.

BRIEF DESCRIPTION OF THE DRAWINGS

The invention will be described in more detail below with reference to the attached drawings, in which:

FIG. 2 shows a part of the coupling devices according to FIG. 1 in cross-section, and FIG. 3 shows a part of the coupling devices according to FIG. 1 in another cross-section.

DESCRIPTION OF EXAMPLE EMBODIMENTS

Figure 1:
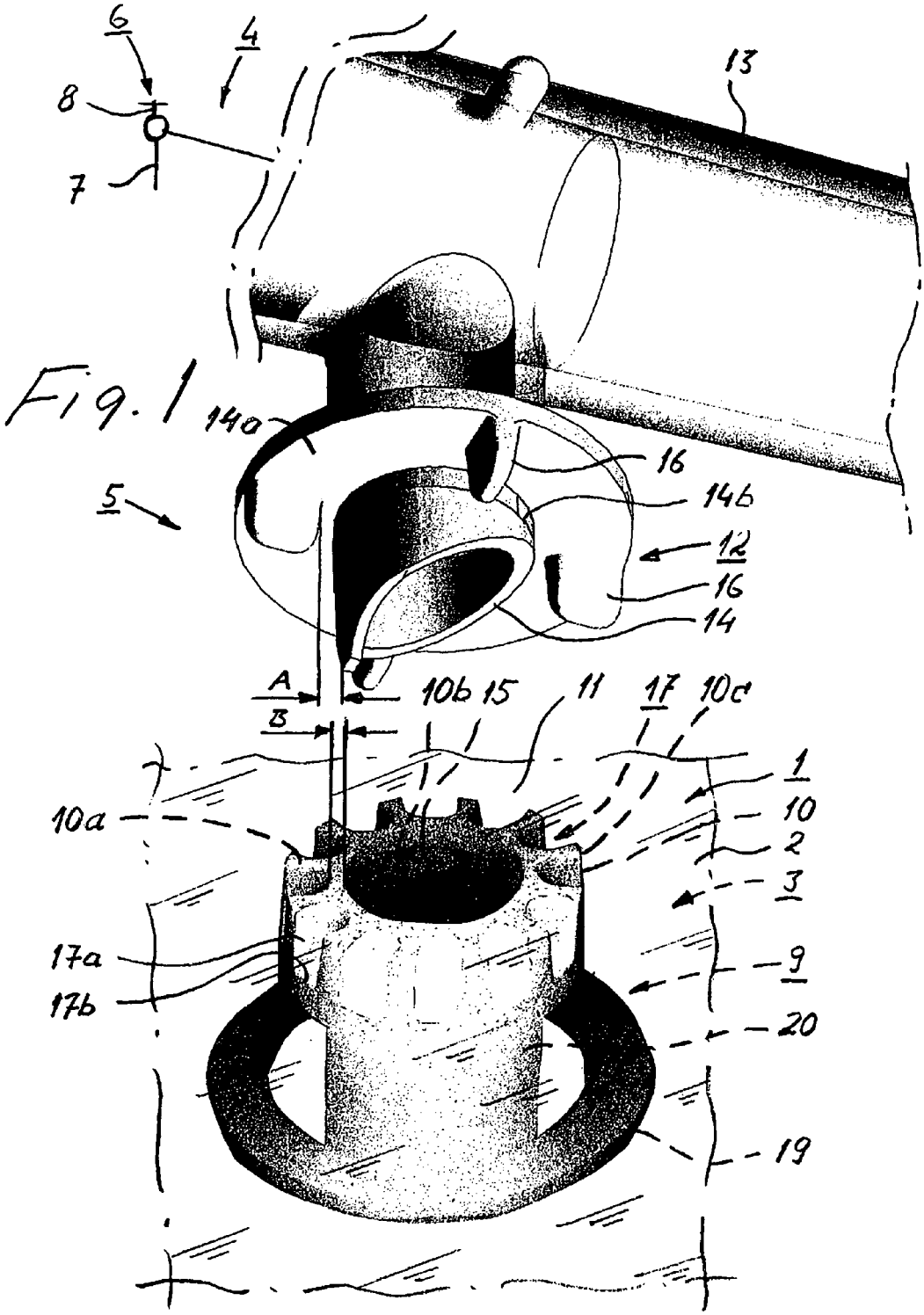
FIG. 1 shows in perspective views an inner and an outer coupling device according to the invention that are parts of a coupling arrangement and that are to be coupled.

The drawings show part 1 of a package, the walls 2 of which consist fully or partially of synthetic material and which may be, for example, a plastic bag. The contents 3 of the package 1 are liquid or essentially liquid, and may consist of foodstuffs, such as, for example, ketchup, mustard, mayonnaise, dressing, or similar.

A withdrawal arrangement 4 is intended for the withdrawal of the contents 3 from the package 1 and a coupling arrangement 5 is intended to allow coupling of the withdrawal arrangement 4 to the package 1 such that the contents 3 of the package 1 can be withdrawn from the package.

The withdrawal arrangement 4 may be a pump 6 that is partially shown in FIG. 1 and that may comprise an outlet tube 7 and a pump means 8 that can be operated manually. The pump 6 may be designed in known manner such that pumping actions of the pump means 8 withdraw contents 3 from the package 1 by suction and feed the contents out through the outlet tube 7.

The coupling arrangement 5 comprises an inner coupling device 9 that is arranged within the package 1 and that comprises an outer part 10, through which the inner coupling device 9 is arranged on the inner surface of an unbroken section 11 of the wall 2 of the package 1.

The coupling arrangement 5 comprises furthermore an outer coupling device 12 that is arranged on the withdrawal arrangement 4, thus on the pump 6 in the design shown in the drawings. In more detail, the outer coupling device 12 is arranged on the lower part of a pump housing 13 that is part of the pump 6. The outer coupling device 12 comprises a tube section 14 with which the unbroken section 11 of the walls 2 of the package can be broken, and that can be introduced into a hole 15 in the outer part 10 in order to be coupled to this part such that the contents 3 of the package 1 can be withdrawn through the tube section 14.

When the unbroken part 11 of the wall is broken with the aid of the tube section 14, parts of the part 11 of the wall will be folded in into the hole 15 (these inwardly folded parts are not shown in the drawings), and the tube section 14 is pressed into the hole 15 to such an extent that it is in tight contact with the part 10 that is provided with holes.

At least one protruding part 16 is arranged on the withdrawal arrangement 4, to be more precise at the pump housing 13, or on a flange 14*a* on the tube section 14, or on both. At least one space 17 is arranged in the outer part 10. When the coupling devices 9, 12 are coupled together, the protruding part 16 can insert a section 11*a* of the unbroken part 11 into the space 17 without breaking the unbroken part 11 or said section 11*a* of the same. This construction eliminates the risk that contents 3 in the package 1 can come into contact with surrounding air before these contents 3 are withdrawn from the package 1.

The protruding part 16 is preferably positioned on such a distance A from the tube section 14 which is the same or greater than the distance B between the opening 17 and the hole 15 in the outer part 10 for the tube section 14.

Preferably, the protruding part 16 and/or the space 17 is/are designed such that there is a small space 18 for the section 11*a* of the unbroken part 11 of the wall 2 which is laying between walls of the space 17 and the protruding part 16 when this part 16 is introduced into the space 17. This construction additionally prevents the risk that the section 11*a* of the wall 2 is broken by the protruding part 16 and/or by the walls of the space 17 when the protruding part 16 is introduced into the space 17.

According to a preferred design, the space 17 is a channel 17*a* which is extending inwards from the outer surface 10*a* of the outer part 10 to an inner bottom part 17*b*. Moreover, according to the preferred design, the outer part 10 inside the hole 15 forms at least one edge 10*b* behind which a coupling part, e.g. a hook portion 14*b*, of the outer coupling device 12 can be hooked for coupling the inner and outer coupling devices 9, 12 together.

The space 17 is preferably open towards the unbroken part 11 of the wall 2 and also at an outer edge 10*c* of the outer part 10 of the inner coupling device 9.

As shown in FIG. 1, a ring of spaces 17 are arranged in the outer part 10 around the hole 15 for the tube section 14. As further shown in FIG. 1, twelve spaces 17 are arranged (there could also be eight or ten spaces in the ring) and there are arranged four protruding parts 16 (there could be one, two or three protruding parts 16).

The design of the spaces 17 can have the shape of a part of a circle which is open at the outer edge 10*c* of the outer part 10.

FIG. 1 makes it clear that the inner coupling device 9 can consist of the part 10, which may be brought into contact with the unbroken part 11 of the wall 2 with the aid of a "plastic weld" or by another suitable means, and that may be a part with the shape of a ring with a hole 15 that is, for example, circular or essentially circular, while the tube section 14 has an equivalent shape. The inner coupling device 9 can, furthermore, comprise an inner part 19 with the shape of a ring and ribs 20 that connect this with the part 10 that is provided with holes.

The inner coupling device 9 can be used to couple to the same outer coupling device (not shown in the drawings), which comprises a tube section 14 that has a shape that is adapted to the shape of the hole 15 in the part 10 of the inner coupling device 9 that is provided with openings but that lacks one or more protruding parts 16. Several different coupling devices can in this way be coupled to the inner coupling device 9 while outer coupling devices with such forms that are to be totally prevented from being able to be coupled to the inner coupling device 9 are prevented from being coupled to it. For example, if the hole 15 of the inner coupling device 9 is circular, the outer coupling device may be cylindrical and lack protruding parts 16 and/or the protruding parts 16 must be designed to be introduced into the spaces 17.

The invention is not limited to the design described above and shown in the drawings, it can vary within the framework of the attached patent claims. As examples that have not been described can be mentioned that the coupling devices 9, 12 may be arranged on other arrangements or packages than those described, the withdrawal arrangement may, for example, be a tube or a pipe instead of a pump, the protruding part of the outer coupling device may be designed or arranged in another way, and they may be designed in a different manner. Thus, there may be one or several protruding sections on the outer coupling device and there may be one or several spaces in the inner coupling device for the protruding part. The withdrawal arrangement 4 can be a tap instead of a pump 6, out through which the contents 3 of the package 1 can flow when it is opened.

The invention claimed is:

1. A coupling arrangement for coupling a withdrawal arrangement (4) to a package (1) with liquid or essentially liquid contents (3), which withdrawal arrangement (4) is intended for the withdrawal of the contents (3) from the package (1), wherein:

at least significant parts of the package (1) consist of synthetic material, the coupling arrangement (5) comprises an inner coupling device (9) that is arranged within the package (1) and welded to the wall (2) of the package (1) and that comprises an outer part (10) that is provided with holes through which part it is arranged on the inner surface of an unbroken part (11) of the wall (2) of the package (1), the coupling arrangement (5) comprises an outer coupling device (12) that is arranged on the withdrawal arrangement (4), the outer coupling device (12) comprises a tube section (14) with which the unbroken part (11) of the wall of the package (1) can be broken and that can be introduced into the hole (15) in the outer part (10) of the inner coupling device (9) in order to be coupled to this such that the contents (3) in the package (1) can be withdrawn through the tube section (14), and the outer coupling device (12) comprises at least one protruding part (16) and the inner coupling device (9) at least one space (17) into which the protruding part (16) of the outer coupling device (12) can be introduced so that the inner and outer coupling devices (9, 12) can be coupled together, the at least one space (17) having an inner bottom part (17*b*) and being open towards the unbroken part (11) of the wall (2) and at an outer edge (10*c*) of the outer part (10) of the inner coupling device (9), the protruding part (16) of the outer coupling device (12) and/or the space (17) and/or unbroken parts (11) of the wall of the package (1) which covers the space (17), are designed such that said unbroken parts (11) of the wall (2) can be inserted into the space (17) by the protruding part (16) without breaking said parts (11).

2. The coupling arrangement according to claim 1, wherein the protruding part (16) of the outer coupling device (12) is positioned on such a distance (A) from the tube section (14) which is the same as or greater than the distance (B) between the space (17) and the hole (15) in the outer part (10) for the tube section (14).

3. The coupling arrangement according to claim 1, wherein the protruding part (16) is arranged on a flange (14*a*) which is arranged on the tube section (14).

4. The coupling arrangement according to claim 3, wherein the tube section (14) has an axis, the at least one protruding part (16) including a plurality of radially extending spaced-apart protruding parts (16) extending from the flange (14*a*), each of the radially extending spaced-apart protruding parts (16) having surfaces extending generally radially that are spaced from the surfaces extending generally radially of the other protruding parts (16).

5. The coupling arrangement according to claim 1, wherein the protruding part (16) and/or the space (17) is/are designed such that there is a small space (18) for the unbroken part (11) of the wall (2) between the protruding part (16) and walls of the space (17) when said unbroken part (11) is introduced in the space (17).

6. The coupling arrangement according to claim 1, wherein the outer part (10) inside the hole (15) forms at least one edge (10*b*) behind which a coupling part (14*b*) of the outer coupling device (12) can be coupled for coupling the outer and inner coupling devices (9, 12) together.

7. The coupling arrangement according to claim 1, wherein a ring of spaces (17) is arranged in the outer part (10) around the hole (15) for the tube section (14).

8. The coupling arrangement according to claim 7, wherein each space (17) comprises a channel formed in the outer part (10) and extending from an open end to a closed end at the inner bottom part (17*b*) of the outer part (10).

9. The coupling arrangement according to claim 1, wherein:

the hole (15) in the part (10) that is provided with holes is circular or essentially circular, and the tube section (14) has a shape that essentially corresponds to this.

10. The coupling arrangement according to claim 1, wherein at least the inner coupling device (9) consists of synthetic material.

11. The coupling arrangement according to claim 1, wherein the contents of the package (1) are liquid or half-liquid foodstuffs, such as, for example, ketchup, mustard, mayonnaise, dressing or similar.

12. The coupling arrangement according to claim 1, wherein the package (1) is a plastic bag.

13. The coupling arrangement according to claim 1, wherein the inner coupling device (9) comprises an inner part (19) with the shape of a ring that is coupled to the outer part (10).

14. The coupling arrangement according to claim 1, wherein the tube section (14) has an axis, the at least one protruding part (16) including a plurality of radially extending spaced-apart protruding parts (16), each of the radially extending spaced-apart protruding parts (16) having surfaces extending generally radially that are spaced from the surfaces extending generally radially of the other protruding parts (16).

15. A coupling arrangement for coupling a withdrawal arrangement (4) to a package (1) with liquid or essentially liquid contents (3), which withdrawal arrangement (4) is intended for the withdrawal of the contents (3) from the package (1), wherein:

at least significant parts of the package (1) consist of synthetic material, the coupling arrangement (5) comprises an inner coupling device (9) that is arranged within the package (1) and that comprises an outer part (10) that is provided with holes through which part it is arranged on the inner surface of an unbroken part (11) of the wall (2) of the package (1), the coupling arrangement (5) comprises an outer coupling device (12) that is arranged on the withdrawal arrangement (4), the outer coupling device (12) comprises a tube section (14) with which the unbroken part (11) of the wall of the package (1) can be broken and that can be introduced into the hole (15) in the outer part (10) of the inner coupling device (9) in order to be coupled to this such that the contents (3) in the package (1) can be withdrawn through the tube section (14), and the outer coupling device (12) comprises at least one protruding part (16) and the inner coupling device (9) at least one space (17) into which the protruding part (16) of the outer coupling device (12) can be introduced so that the inner and outer coupling devices (9, 12) can be coupled together, the protruding part (16) of the outer coupling device (12) and/or the space (17) and/or unbroken parts (11) of the wall of the package (1) which covers the space (17), are designed such that said unbroken parts (11) of the wall (2) can be inserted into the space (17) by the protruding part (16) without breaking said parts wherein there are provided two, three or four protruding parts (16) and eight, ten or twelve spaces (17).

* * * * *